United States Patent [19]

Gelinas, Jr.

[11] Patent Number: 4,877,166

[45] Date of Patent: Oct. 31, 1989

[54] APPARATUS FOR RETAINING A BALL

[76] Inventor: Robert C. Gelinas, Jr., 493 Gregory La., West Chester, Pa. 19380

[21] Appl. No.: 189,019

[22] Filed: May 2, 1988

[51] Int. Cl.[4] ..... A45F 5/00

[52] U.S. Cl. ..... 224/223; 224/236; 224/224; 273/32 D; 273/67 R; 273/25; 273/29 R; 206/315.9

[58] Field of Search ..... 273/58 C, 72 R, 73 J, 273/25, 29 R, 32 D; 224/919, 165, 219, 223, 224, 236; 221/307, 309, 310; 206/315.9

[56] References Cited

U.S. PATENT DOCUMENTS

| | | | |
|---|---|---|---|
| 1,572,383 | 2/1926 | Dennys | 273/32 D |
| 1,955,559 | 9/1934 | Narrow | 221/309 |
| 2,598,330 | 4/1951 | Wiseman | 224/919 |
| 2,768,775 | 10/1956 | Hower | 224/919 |
| 2,932,514 | 4/1960 | Bergmark | 224/919 |
| 3,412,897 | 11/1968 | Slater | 221/309 |
| 4,061,256 | 12/1977 | Beer et al. | 224/919 |
| 4,088,251 | 5/1978 | Rodriguez | 221/309 |
| 4,296,874 | 10/1981 | Evans | 224/919 |
| 4,365,804 | 12/1982 | Melvin | 224/919 |

FOREIGN PATENT DOCUMENTS

| | | | |
|---|---|---|---|
| 326925 | 3/1930 | United Kingdom | 224/919 |

*Primary Examiner*—Edward M. Coven
*Assistant Examiner*—Mark S. Graham
*Attorney, Agent, or Firm*—Hill, Van Santen, Steadman & Simpson

[57] ABSTRACT

A device for holding an object is provided. The device includes a body for defining an interior cavity for securely retaining an object in surrounding relationship. The body includes an opening for insertion of the object into and removal of the object from the interior cavity. The device includes a member for attaching the device to a second object.

8 Claims, 1 Drawing Sheet

FIG. 1
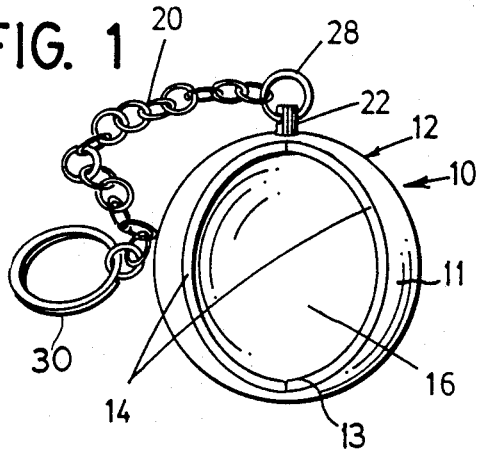
FIG. 2
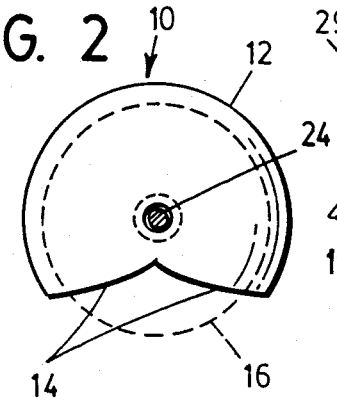
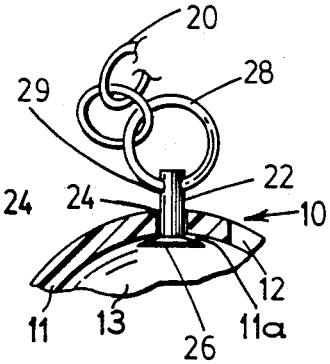
FIG. 4
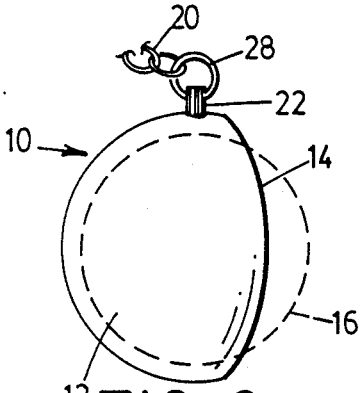
FIG. 3
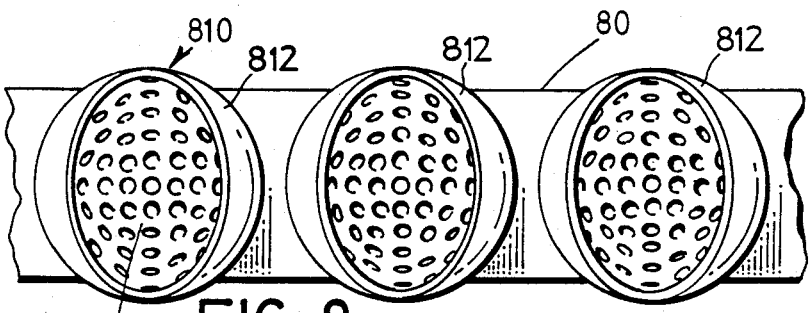
FIG. 8
FIG. 9
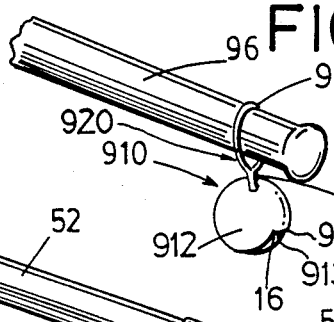
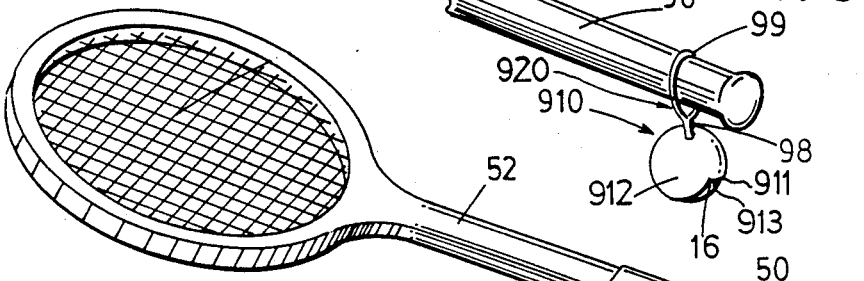
FIG. 5
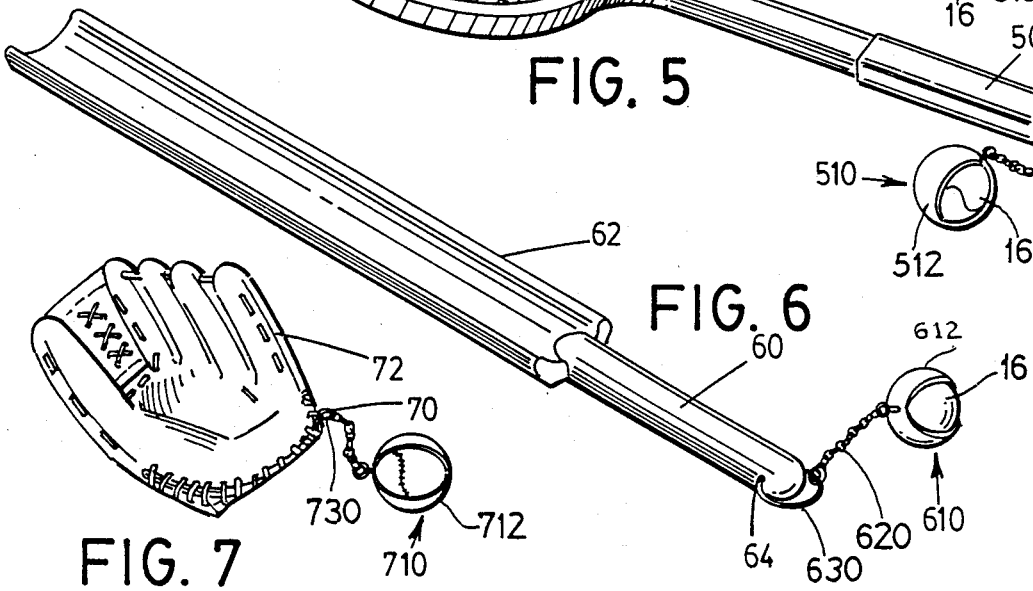
FIG. 6
FIG. 7

APPARATUS FOR RETAINING A BALL

BACKGROUND OF THE INVENTION

The present invention is directed to an apparatus for retaining a ball or other object that allows the ball to be coupled to a second object.

There are many instances in which two objects are used to cooperate with each other in some manner. For example, in many sports, balls are used which cooperate with other objects such as bats, racquets, gloves and the like.

These balls can have a variety of different shapes and sizes. In sports such as baseball, golf, tennis, and racquetball, the ball-type objects are spherically-shaped. In other sports, such as American-style football, the ball is oblong or oval-shaped.

When it is desired to play one of these sports, the participants must transport the ball or other object to wherever the game will be played, e.g., playing field, court, or course. Typically, the ball is transported by being carried in hand or in a device such as a box, bag, can, or case. Invariably, the objects are not visible within such devices and the devices have to be opened to determine if the appropriate ball is within the device. Moreover, the devices can be bulky or hold a plurality of such ball-type objects while only one such object is desired or needed.

In some sports, such as golf, the participants usually carry spare objects on their persons, in pockets or bags, as they play the game. This can be bothersome as the objects do not comfortably fit within one's pockets.

In sports where the objects cooperate with another object such as a bat, racquet, club or the like, it is highly desirable to keep the two objects together during storage and/or transportation. Due to their size and nature, the ball-type objects can easily be separated from the cooperating objects and become lost. This can be a great inconvenience if no spares are readily available. Moreover, it may lead to duplicative purchases if the ball-type objects are merely misplaced and simply overlooked.

These disadvantages are not limited to sporting apparatus, however, and can be found in other situations involving two cooperating objects, such as, for example, a wrench and a socket. Frequently, sockets are lost rendering the wrench body useless for certain applications. Similar concerns and disadvantages are also present in other situations where two objects do not necessarily cooperate with each other, but where it may be desired to keep them together, such as, for example, a bottle of suntan lotion and jar of sunscreen.

SUMMARY OF THE INVENTION

The present invention provides a device for holding an object. The device includes a body constructed from a resilient material and defining an internal cavity for holding an object in a surrounding relationship. The body includes an opening for allowing the insertion of the object into and removal of the object from the cavity. The device further includes a means for attaching the device to a second object.

Preferably, the opening is so constructed and arranged that a portion of the object is visible when the object is retained within the internal cavity.

In an embodiment, the cavity of the device is spherically-shaped and has an opening so constructed and arranged that it can accept a spherically-shaped object.

The spherically-shaped cavity has a size slightly greater than that of the spherically-shaped object so that it can hold the object in a surrounding relationship.

In an embodiment, the means for attaching preferably includes a flexible member attached to the body of the device for attaching the device to a second object.

In an embodiment, the body of the device is constructed from a pliable rubber.

In an embodiment, the means for attaching the device to a second object includes a chain.

In an embodiment, the device includes a body constructed from a pliable rubber and having means for attaching that are integral.

In an embodiment, the means for attaching is a flexible member having an unattached end having a ring formed integrally thereon for attaching the device to a second object.

In an embodiment, the device is coupled to a second object that cooperates with a ball for playing a game.

In an embodiment, the device includes a plurality of body members for receiving a plurality of objects.

BRIEF DESCRIPTION OF THE DRAWINGS

FIG. 1 illustrates a front view of a device for retaining a ball of the present invention.

FIG. 2 illustrates a top view of the device of FIG. 1 with parts removed and with parts broken and shown in section.

FIG. 4 illustrates a fragmentary sectional view, partially broken away, of the device of FIG. 1 to show additional details of structure.

FIG. 3 illustrates a side view of the device of FIG. 1.

FIG. 8 illustrates a front view of a belt including a plurality of retaining devices of the present invention;

FIG. 5 illustrates a perspective view of a device for retaining a ball attached to a racquet;

FIG. 6 illustrates a perspective view of a device for retaining a ball attached to a stick designed to cooperate with the ball to play a game.

FIG. 7 illustrates a perspective view of a device for retaining a ball attached to a baseball glove.

FIG. 9 illustrates a perspective view of a device for retaining a ball having integrally formed means for attaching the device to an object such as a baseball bat.

DETAILED DESCRIPTION OF THE PRESENTLY PREFERRED EMBODIMENTS

The present invention provides a convenient means for storing and transporting a ball or similar object. As used herein, the term "ball" means not only a spherical object for playing a game, but other similar objects including nonspherical objects, such as a football.

Referring to FIGS. 1, 2, 3, and 4, there is shown an apparatus 10 for retaining and storing a ball 16. In the embodiment illustrated, the apparatus 10 includes a body 12, preferably made of a resilient material, such as pliable rubber. of course, the body 12 can be made of other resilient materials such as certain woven fabrics, elastomers, and the like. However, the material should have properties that will allow it to conform to the shape of an object to be held and to tightly surround the object.

The body 12 includes walls 11 that define an interior cavity 13. The interior cavity 13 is constructed so that it will receive and retain a ball 16 in a surrounding relationship. Accordingly, the interior cavity 13 has a shape and size substantially similar to or at least complemental with that of the object to be retained.

The body 12, and sepcifically walls 11, includes an opening 14 through which a ball 16 can be inserted and removed. The ball 16 is inserted and removed by stretching the opening 14. The body is made of a material having a sufficient memory or elasticity so that it will return to its original shape after deformation or elastic stretching. The opening 14 is so constructed and arranged that it normally blocks egress from the body 12 and securely retains the ball 16 within the interior cavity 13. The opening 14 can be formed by introducing a wedgeshaped slice in the walls 11 of the body 12. Other slice shapes may also be used, such as slits, so long as the body 12, and specifically, interior cavity 13, is able to tightly grasp the ball 16.

As illustrated in FIGS. 1, 2, 3, and 4, the walls 11 of the body 12 securely surround the ball 16 when it is positioned within the interior cavity 13. Although the apparatus 10 securely retains the ball 16 within the body 12, the apparatus is constructed to allow the user to view a portion of the ball without removing it from the body 12. To this end, a portion of the ball 16 is exposed by the opening 14. Thus, the ball 16 is securely held within the interior cavity 13 while at the same time, a portion thereof is exposed so that it can be identified.

The body 12 of the device 10 can have a variety of different sizes and shapes so that it corresponds to and can accommodate any size or shape of balls 16. By way of example, although not illustrated, the interior cavity 13 can be oval-shaped to hold an American-style football or rugby ball. Because the walls of the body 12 that define the interior cavity 13 securely receive the ball 16, the interior cavity 13 should have a shape substantially similar to the ball or other object to be held.

Preferably, the walls of the body 12 have a thickness of approximately 1/8 of an inch to about ⅛ of an inch. However, depending on the material and the ball to be retained, the walls 11 of the body 12 can be thicker or thinner.

As illustrated in FIGS. 1–4, the device 10 includes a means for attaching the body 12 to another object. The means for attaching allows one to attach a first object, a ball or other object 16, to a second object, such as a racquet or glove, designed to cooperate with the first object. By coupling the ball 16 to the second object, the chances that the two objects will become separated during storage or transportation is reduced. Furthermore, by coupling the ball and second object, it is not necessary to search for two separate objects every time one desires to play a certain game.

In the preferred embodiment illustrated, the means for attaching includes a chain 20 that is attached at one end to the body 12. Instead of a chain, however, a string, rope, or other flexible member can be used as the means for attaching. For example, in FIG. 9, there is shown a flexible member made of a pliable rubber integrally formed with the body 912.

As is most clearly illustrated in FIG. 4, the chain 20 is attached to the body 12 by means of a stud 22 that extends from the body 12 through a hole 24. The stud 22 includes a flat head portion 26 for retaining the stud 22 within the hole 24. Preferably, the stud 22 is secured to an interior wall 11a of the body 12 by an adhesive. However, other means can be used to secure the stud 22 to the body 12 such as a snap or heat sealing.

To secure the stud to the chain 20, a ring 28 is coupled to an end link of the chain 20 and a bore 29 in the stud 22 attaching the chain 20 to the body 12. At a second end of the chain 20, as illustrated in FIG. 1, another ring 30, such as a split ring, is located. The ring 30 can be attached to a second object by means that accept the ring 30, such as, for example, a loop or the like. Of course, if desired, the ring 30 can be omitted and the chain 20 simply can be tied or attached by other means to the object.

Referring to FIG. 5, the device 510 is illustrated attached to an eyelet 54 of a handle 50 of a racquet 52 by means 520. A number of sports, such as tennis, racquetball, and squash utilize a racquet 52 and ball 16 in cooperation. The present invention allows the racquet and ball to be coupled together for storage and transportation. The racquet 52 can be of any type so long as a ring or eyelet 54 can be coupled or secured thereto.

Referring to FIG. 6, the device 610 is illustrated attached to a handle 60 of an elongated member, hereinafter "stick" 62. The ring 630 of the means 620 for attached the body 612 to an object is shown looped through a hole 64 in the handle 60 of the stick 62. The stick 62 shown is disclosed in applicant's pending continuation-in-part application, Ser. No. 060,226, filed June 10, 1987 now U.S. Pat. No. 4,752,076. As set forth therein the stick is used with a ball to play a number of games.

Referring to FIG. 7, the device 710 is shown attached to a portion of a softball or baseball glove 72. Preferably, the body 712 of the device 710 is secured to the stitching of the glove. To this end, the ring 730 is simply looped through a loop in the stitching 70. The device 710, of course, can be similarly attached to any of a variety of other gloves, not illustrated.

Referring to FIG. 8, a further embodiment of the device 810 is illustrated. In this embodiment, a plurality of bodies 812 are illustrated attached to a belt or strap 80 to hold a plurality of golf balls 82. The bodies 812 can be attached to the belt or strap 80 by any of a variety of suitable means including, for example, adhesives, staples, buttons, or snaps. The use of such a belt 80 is ideal for golfers and the like who need or desire to carry golf balls and the like on their persons. As can be appreciated, the belt 80 allows the balls to be readily available to the wearer.

Referring to FIG. 9, there is illustrated an embodiment of the device 910 that is similar to the device 10 illustrated in FIGS. 1–4 but which includes a different means for attaching the body 912 to an object. As illustrated, the device 910 includes walls 911 that define an interior cavity 913 for securely holding a ball 16, such as a baseball. The device 910 further includes means 920 for attaching the device 910 to a baseball bat 96. The means for attaching includes a flexible member 98 made of pliable rubber. The device 910 is made of the same pliable rubber and thus, the means 98 and device 910 are integrally formed.

As illustrated, the means 98 also includes an integrally formed loop end 99 that is so constructed and arranged that it can be received around the handle of the bat. Because the loop 99 is also made of a pliable rubber, it also is resilient and fits snugly about the handle portion of the baseball bat 96. Of course, the device 910 can be used with other balls and other corresponding objects.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

I claim:

1. A device for holding an object comprising a spherical body having walls that define a substantially enclosed interior cavity having a dimension substantially similar to the dimension of an object to be held by the device, the body including an opening in communication with the interior cavity and an exterior environment for allowing the object to be positioned in and removed from the interior cavity, the opening being so constructed and arranged that the object is retained by the interior cavity when received therein, the device further including means for coupling the device to a second object, the body being constructed from resilient material, the interior cavity being spherically-shaped, the opening of the body having the form of a wedge shaped slice and being so constructed and arranged that at least a portion of the object is visible through the opening when the ball is secured to the interior cavity.

2. The device of claim 1 wherein the body is constructed from a pliable rubber.

3. An apparatus for playing a game wherein a first ball-like object is designed to cooperate with at least one second object comprising:

a first ball-like object;

a second stick-like object for cooperating with the first object, said second object including a handle; and a device for coupling the first object to the second object including a spherically shaped body constructed from a resilient material defining an interior cavity having a shape and size substantially similar to the shape and size of the first object for securely receiving the first object and retaining same in a surrounding relationship, the body including an opening having the form of a wedge shaped slice and communicating with the interior cavity and an exterior environment for allowing the first object to be received within and removed from the interior cavity, the opening being so constructed and arranged that at least a portion of the first object is visible when it is positioned within the interior cavity, the interior cavity being spherically-shaped, the device including means for coupling the device to the second object, the means for coupling the device including a ring member that is received within an opening in the handle in the second object and an elongated flexible member attached at one end to the ring and attached at another end to the body, the device being removably coupled to the second object.

4. The device of claim 3, wherein said elongated flexible member is a chain.

5. A device for holding one or more objects comprising:

at least one spherically shaped body constructed from a resilient material and having an interior for receiving and securely holding one object in surrounding relationship and including an opening having the form of a wedge shaped slice for permitting insertion of said object into and removal of said object from said interior, said opening allowing visual inspection of at least a portion of said object when said object is retained in said body, said interior cavity being of a spherical shape; and means for attaching each said body to a second object, said means for attaching also removably securing the body to the second object.

6. The device of claim 5 wherein said second object is a belt.

7. The device of claim 6 wherein said belt includes a plurality of bodies.

8. A transportable storage device for a ball-shaped object comprising:

a spherical body having a flexible elastic wall means forming a spherical cavity of a shape which is essentially complemental to that of an object to be transported, said wall means having an opening in the form of a wedge shaped slice formed therein which is normally smaller than the object to be transported and which is elastically deformable to permit selective insertion and removal of the object into and out of the cavity, said opening being of a sufficient size to expose a discernible surface portion of the object when inserted in the cavity but having elastically returnable eges surrounding said opening to closely confine and retain the object in assembly with the enclosure, said opening being formed in less than one-half of the spherical wall means; and coupling means attached to said enclosure for selectively connecting the enclosure to a transporting means, said coupling means including a stud extending through said enclosure walls and a flexible member attached on one end to said stud and attached on another end to a ring.

* * * * *